US009066571B2

(12) United States Patent
Pflugfelder

(10) Patent No.: US 9,066,571 B2
(45) Date of Patent: Jun. 30, 2015

(54) FOUR-FINGERED COSMETIC GLOVE

(76) Inventor: Dunja Pflugfelder, Cologne (DE)

( * ) Notice: Subject to any disclaimer, the term of this patent is extended or adjusted under 35 U.S.C. 154(b) by 0 days.

(21) Appl. No.: 13/877,351

(22) PCT Filed: Oct. 25, 2011

(86) PCT No.: PCT/EP2011/068582

§ 371 (c)(1),
(2), (4) Date: Apr. 2, 2013

(87) PCT Pub. No.: WO2012/055831

PCT Pub. Date: May 3, 2012

(65) Prior Publication Data

US 2013/0198932 A1 Aug. 8, 2013

(30) Foreign Application Priority Data

Oct. 28, 2010 (DE) ..... 10 2010 049 973

(51) Int. Cl.
*A41D 19/00* (2006.01)
*A45D 44/00* (2006.01)

(52) U.S. Cl.
CPC ..... *A45D 44/00* (2013.01); *A41D 19/0017* (2013.01)

(58) Field of Classification Search
CPC ..... A41D 19/002
USPC ..... 2/158, 159, 160, 161.1, 161.3, 163, 2/167, 16, 18, 20
See application file for complete search history.

(56) References Cited

U.S. PATENT DOCUMENTS

| | | | | |
|---|---|---|---|---|
| 3,728,738 | A * | 4/1973 | Andolino | 2/161.1 |
| 4,531,241 | A * | 7/1985 | Berger | 2/161.2 |
| 4,825,499 | A * | 5/1989 | Baptiste | 15/227 |
| 6,338,163 | B1 | 1/2002 | Markson | |
| 6,513,998 | B1 * | 2/2003 | Barry | 401/7 |
| 7,086,094 | B1 * | 8/2006 | Ismailyan | 2/159 |
| 7,328,523 | B2 * | 2/2008 | Vossoughi et al. | 34/90 |
| 8,028,386 | B2 * | 10/2011 | Rock et al. | 28/160 |
| 8,602,073 | B2 * | 12/2013 | Swain | 150/106 |
| 8,776,268 | B2 * | 7/2014 | Rodgers et al. | 2/160 |
| 2004/0064870 | A1 | 4/2004 | Gold | |
| 2006/0064796 | A1 | 3/2006 | Hernandez | |
| 2007/0025932 | A1 | 2/2007 | Ponce et al. | |
| 2007/0264894 | A1 | 11/2007 | Lerner | |
| 2008/0010718 | A1 | 1/2008 | Richards | |

FOREIGN PATENT DOCUMENTS

| | | | |
|---|---|---|---|
| DE | 1971013 | | 10/1967 |
| DE | 2757130 | A1 | 7/1978 |
| DE | 8802559.4 | U1 | 4/1988 |
| DE | 29602973 | U1 | 8/1996 |
| DE | 20304298 | U1 | 7/2003 |
| EP | 1153553 | A1 | 11/2001 |
| GB | 1069863 | | 5/1967 |
| GB | 2372424 | A | 8/2002 |

* cited by examiner

*Primary Examiner* — Tejash Patel
(74) *Attorney, Agent, or Firm* — Clements Bernard PLLC; Gregory N. Clements

(57) ABSTRACT

The invention relates to a four-fingered cosmetic glove comprising a fiber pile fabric. Multiple work devices of a makeup artist for example can be replaced with the glove, whereby work can be done more effectively.

12 Claims, 4 Drawing Sheets

FOUR-FINGERED COSMETIC GLOVE

The present invention relates to a four-fingered cosmetic glove comprising a fiber pile fabric. The glove can replace multiple tools, for example, of a make-up artist, whereby work can be done more effectively.

In fields where people need a special appearance in public, such as in photo shootings, film, theater, musical or opera, such people are correspondingly made-up and styled by other persons. For example, normal make-up artists are responsible, in particular, for the make up of people and can be found especially in the fields of bridal make-up, evening make-up, gala make-up, and catwalk make-up. Movie and stage make-up artists are additionally responsible for the make-up and realistic disguising in terms of visible body parts and proportions, for example, of actors and singers.

A close contact is necessary between the make-up artists and the persons to be made-up, such as actors, models or singers. For hygienic reasons, it is often desired that there be no direct skin contact between the person applying the make-up and the person to be made-up. Further, the persons involved are strangers to one another in most cases. Direct skin contact, especially in the facial area, is often experienced as unpleasant.

Make-up artists are further in danger of developing a contact allergy against the products employed. Contact eczemas develop in areas of the skin that are regularly in contact with particular chemical compounds.

As a protection from allergic reactions, and also in order to avoid direct skin contact, make-up artists can wear gloves during the application of make-up. For example, gloves made of latex can be worn, as are used in the medical field.

Latex gloves mean only minor limitations to the make-up artist's work. Make-up utensils such as puffs, brushes or sponges can be manually gripped and used in a normal way. However, the touch with such a glove is often experienced as unpleasant, for example, in the face. Further, the skin within the glove starts to sweat, whereby the skins dries. If the skin of the hand is wet, the glove is more difficult to put on, and it often gets broken.

Gloves made of cotton are an alternative. They are more pleasant to wear, since the skin of the hand does not sweat, or only sweats a little, in such gloves. However, such gloves are mostly inelastic. The required sensitive touch is lost thereby. Often, a quick change of make-up utensils is no longer possible then. The make-up is more difficult to apply to delicate areas. In addition, such gloves get dirty quickly. Frequent change together with frequent cleaning is necessary here.

A cosmetic glove made of cellulose is known from the German Utility Model DE 1971 013. Such a glove makes sure that cream applied to the hand does not escape to the outside. Direct contact between the hand of the person applying the make-up and the face of the person to be made-up is avoided here. However, any sensitive touch is lost in such a cushioned glove. Delicate work is no longer possible.

US 2007/0264894 describes a glove comprising a protective coat. When needed, it can be pulled over the glove. The glove is further provided with pockets filled with soap. Such a glove can be used, for example, for cleaning.

A glove for cleaning and care purposes is described in DE 203 04 298 U1. The glove is disposable and preferably serves for body hygiene, cosmetics or for the cleaning and care of articles, consisting of two interconnected plies of an absorbable material. One ply of the non-woven fabric of the glove is soaked with specific detergents for the respective intended use.

EP 1 153 553 A1 describes a glove for cleaning sensitive skin and for applying cosmetically active substances. The glove includes three layers of polymeric materials. These are interconnected to form pockets. The outermost surface is roughened.

A glove package with an impregnated fingerless disposable glove is known from DE 27 57 130 A1. The glove has an impregnated pile surface facing outside.

A sports glove with a pile cover is also known from DE 296 02 973 U1. In this glove, the cover layer of at least the palm surface has a pile cover.

A working glove in which the front and back sides have the same design is described from US 2006/0064796 A1. The glove can be worn on either hand.

Although the gloves described in the prior art and a cotton glove enable protection, especially from a hygienic point of view, there is a disadvantage in that delicate working, which is necessary for make-up artists, is no longer possible. Further, when other persons are made-up, both powdery make-up products, such as face powders or eye shadows, and fatty products, such as creams or face make-ups, are employed. Fatty products cannot be processed with the above mentioned gloves. Rather, the glove must be removed and put on again later. This is complicated and time-consuming. In addition, the glove may get dirty easily.

A make-up artist needs several different tools, such as a powder puff, sponge or brush, to achieve the desired make-up result. These tools must be changed frequently. Especially when working under time pressure, these tools may fall to the floor or otherwise become dirty, so that they can no longer be used. For this reason, several puffs, sponges and brushes always have to be present per person to be made-up. The constant change of tools requires a lot of practice and a high dexterity, and costs a lot of time.

The object of the present invention is to provide a working tool with which the above mentioned drawbacks can be avoided. It should enable simple and flexible handling.

In a first embodiment, the object of the present invention is achieved by a four-fingered cosmetic glove (1) comprising a palmar side (2) including the palm and lower sides of the fingers, a dorsal side (3) including the back of the hand and upper sides of the fingers, and a wrist zone (4), said palmar side (2) comprising a fiber pile fabric, and said glove having a reach-through opening (5) on the level of the thumb basal joint.

Figure 1:
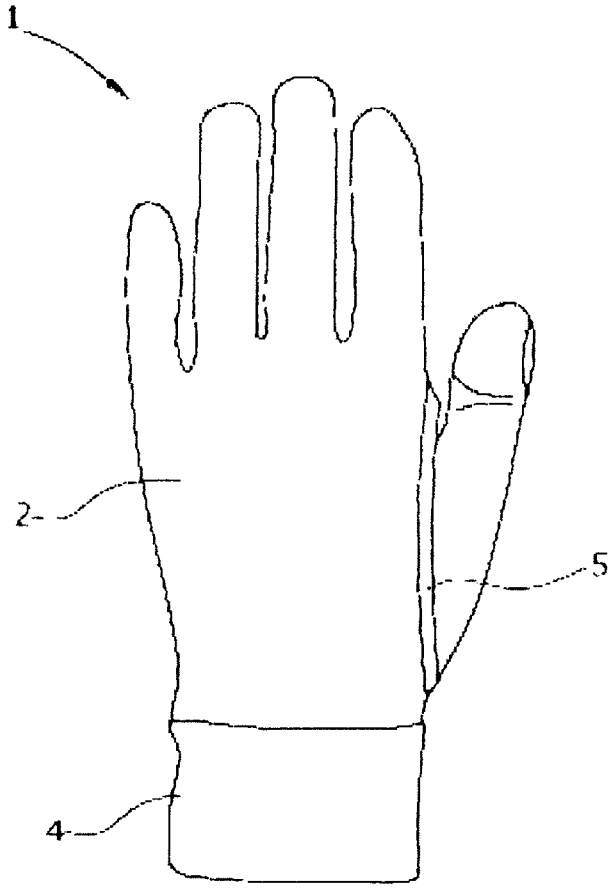
FIG. 1 shows a four-fingered cosmetic glove (1) according to the invention.
Figure 2:
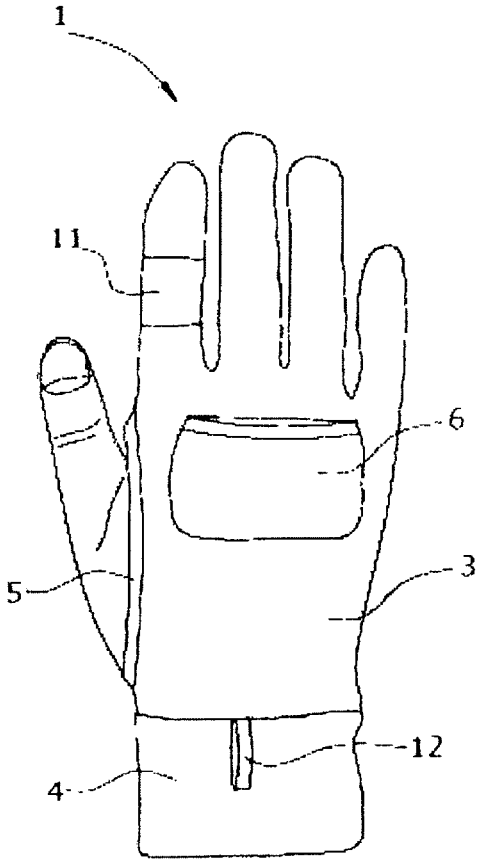
FIG. 2 to FIG. 7 show particular embodiments as described in the following.

A four-fingered cosmetic glove (1) according to the invention allows for a more flexible and more delicate work as compared to work with a conventional powder puff. In addition to the powder puff, sponges and brushed are also completely or partially replaced by the cosmetic glove (1) according to the invention. Since the constant change of tools is dispensed with, it is possible to work more quickly and more flexibly.

The palmar side (2) of the cosmetic glove (1) includes the zone of the palm and lower sides of the fingers D II to D V. D II designates the index finger, D III designates the middle finger, D IV designates the ring finger, and D V designates the little finger.

This palmar side (2) comprises a fiber pile fabric. The latter is suitable for applying powdery products to the skin. In a pile fabric, free ends of the fabric extend outward. This causes a soft and fleecy feel. The fiber pile fabric causes a pleasant feel on the skin of the person to be made-up. Powdery products within the meaning of the present invention include face powders, body powders and/or eye shadows. The glove according to the invention can be used to directly dip into the powdery product, and any excess material can be simply shaken off.

According to the invention, the cosmetic glove (1) can be prepared for either the right or the left hand. If a cosmetic glove (1) is worn on both hands, the palmar side (2) of the other cosmetic glove (1) can be used to shake off excess material on it. If a powdery make-up product is taken up with the right hand, excess material can be shaken off on the palmar side (2) of the cosmetic glove (1) on the left hand, and vice versa.

The cosmetic glove (1) according to the invention enables delicate work, because the fingers are developed separately. For example, when working with so-called oil-absorbing sheets, every spot of a face can be easily reached with the glove according to the invention in order to remove the shine without having to use a brush or puff. There is no change of tools in this case.

In the zone of the thumb basal joint, the cosmetic glove (1) has a reach-through opening (5) according to the invention. The thumb basal joint is not covered by the glove. On this free skin area, different fatty make-up products can be mixed together before being applied to the desired area. A fatty make-up product may also be rubbed on the thumb basal joint first before it is applied to the desired skin area. A "fatty make-up product" within the meaning of the present invention means, in particular, oil-in-water emulsions or water-in-oil emulsions, for example, a care cream, a creamy make-up, a fluid make-up, or a lipstick.

Thus, a four-fingered cosmetic glove (1) according to the invention can replace not only a powder puff, but also a sponge and a brush. This enables work to be done more quickly and more effectively, because a constant change of tools is dispensed with. In addition, there is no risk that the individual tools could fall to the ground and thereby get dirty and thus could no longer be used, especially when working outdoors.

The four-fingered cosmetic glove (1) according to the invention further protects the hand in question or both hands from external influences. In summer, the four-fingered cosmetic glove (1) protects the skin from the sun's ultraviolet rays. In winter, the glove keeps the hand warm, which reduces skin irritation caused by cold. In addition, direct contact between the skin of the hand and the make-up product can be avoided by the four-fingered cosmetic glove (1). Thus, drying and soiling of the skin are avoided. The glove (1) according to the invention offers protection, in particular, for people who are prone to intolerance to the make-up products employed.

In a further embodiment, the fabric on the palmar side (2) of the four-fingered cosmetic glove (1) according to the invention is elastic, especially bi-elastic. Elastic fabrics include those fabrics that are stretchable in one dimension, whereas bi-elastic fabrics include those that are stretchable in two dimensions. A flexible elastic fabric results in an improved wearing comfort of the four-fingered cosmetic glove (1) according to the invention. Especially when delicate work with only one finger is required, an elastic fabric improves adaptation to the finger of the make-up applier and to the skin of the person to be made-up. The formation of wrinkles, which can lead to an unpleasant skin feel in addition to a poor make-up result, is avoided. An elastic, especially bi-elastic, material can conform better to the shape of the hand as compared to inelastic material.

The fiber pile fabric may further be breathable. Especially when the glove is worn over extended periods of time, it is advantageous for the hand not to sweat within the four-fingered cosmetic glove (1). This would lead to an unpleasant skin feel. Further, the skin of the hand would dry out in the four-fingered cosmetic glove (1). However, if a breathable fabric is used, the sweat of the hand can escape. There is no accumulation of heat within the glove. Thus, a breathable fabric results in an improved wearing comfort.

In one embodiment, the palmar side (2) of the four-fingered cosmetic glove (1) according to the invention includes velvet, plush and/or velour. These materials are preferably suitable for applying powdery make-up products. Further, they can be prepared to be stretchable in two dimensions, i.e., bi-elastic. Because of the haptic properties of velvet, plush and/or velour, the four-fingered cosmetic glove (1) according to the invention has a high wearing comfort.

The dorsal side (3) of the four-fingered cosmetic glove (1) according to the invention may exhibit a fabric that is the same as or different from that of the palmar side (2). Preferably, the dorsal side (3) has a fabric different from that of the palmar side (2). The dorsal side (3) includes both the back of the hand and the upper side of the fingers. If the four-fingered cosmetic glove (1) is made from two different materials for the palmar side (2) and dorsal side (3), this may result in an improved wearing comfort.

In a particular embodiment, the dorsal side (3) of the four-fingered cosmetic glove (1) has a reach-through opening or a pocket (6).

If the dorsal side (3) of the glove has a pocket (6), it may comprise a fiber pile fabric. In a preferred embodiment, the pocket (6) comprises the same material as that of the palmar side (2) of the cosmetic glove (1). Preferably, the pocket (6) is positioned in the zone of the metacarpophalangeal joints of fingers D II to D V, spanning at least partially one or more of the metacarpophalangeal joints of fingers D II, D III, D IV and D V.

On the pocket (6), excess make-up material can be shaken off the palmar side (2) of cosmetic glove (1). When applying make-up to a face, the person to be made-up may additionally rest their chin upon the hand of the person applying the make-up, in the zone of pocket (6) of glove (1). This ensures a steady head position. Also, this hand serves as a support in order that fine contours, for example, can be made-up more easily with the other hand. Because of the pocket (6), which is preferably made of the same material as the palmar side (2) of the four-fingered cosmetic glove (1), there is also a pleasant feel on the side of the person being made-up. Further, the fiber pile fabric does not smear a previously achieved make-up result.

Further, when the four-fingered cosmetic glove (1) is worn, there is no direct skin contact between the person applying the make-up and the person to be made-up. If several persons must be made-up within a very short time, for example, in the film or theater field, for example, by a make-up artist, then the wearing of gloves is indicated also under hygienic aspects. For example, if the dorsal side (3) of the cosmetic glove (1) according to the invention is designed in different colors, it is possible to assign one or more cosmetic gloves (1) individually to each person to be made-up. In such a case, each glove can be assigned unequivocally to one person applying the make-up and to one person to be made-up. This increases hygienic conditions for both the person to be made-up and the person applying the make-up.

Thus, the four-fingered cosmetic glove (1) according to the invention does not only replace several tools. This facilitates work, because the constant change of different tools is dispensed with. Also, the hygienic conditions are improved since direct skin contact between persons who are strangers to one another can be reduced to a low level.

In another embodiment, the pocket (6), which is positioned on the dorsal side (3) of the four-fingered cosmetic glove (1), is cushioned. If this pocket (6) is used as a support for the face, especially the chin, of a person, the metacarpophalangeal joints of the hand are protected in one respect. Secondly, the chin is in a comfortable position then, which can also be maintained over a somewhat extended period of time if this should be necessary.

Figure 4:
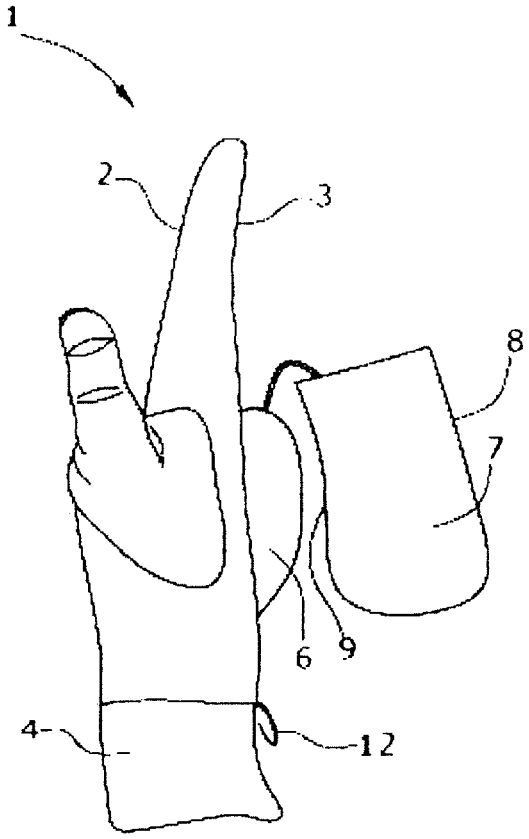
Figure 5:
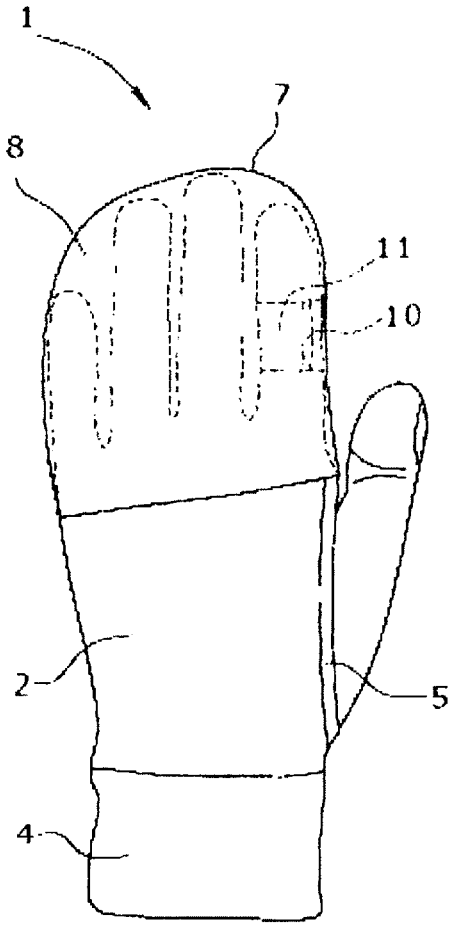
Figure 6:
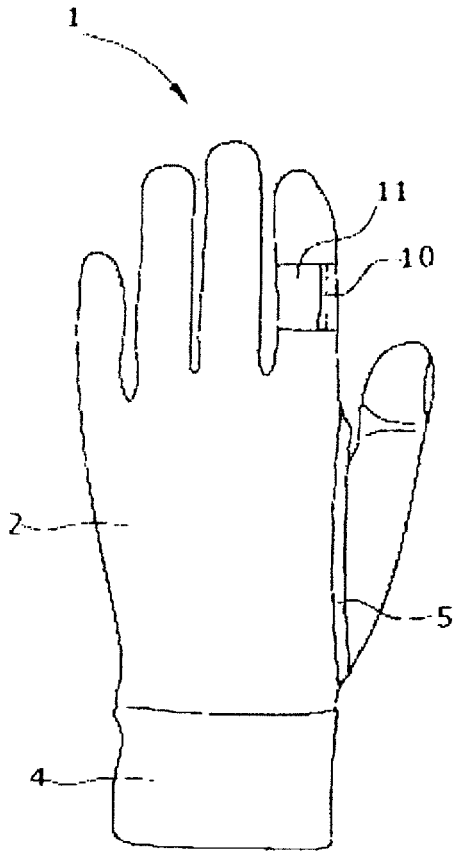
Figure 7:
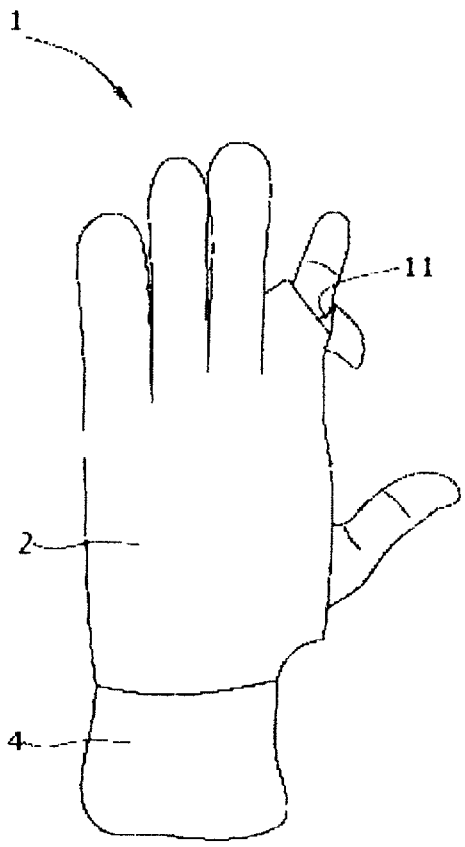

The reach-through opening or the pocket (6) may further have a bag (7) including a top side (9) and a bottom side (8), which can have a semicircular, semi-oval or ergonomic design. The bag (7) is attached through a connecting part to the dorsal side (3) of the four-fingered cosmetic glove (1). If needed, the bag (7) can be pulled over the fingers D II to D V, as schematically shown in FIG. 3 to FIG. 5.

Figure 3:
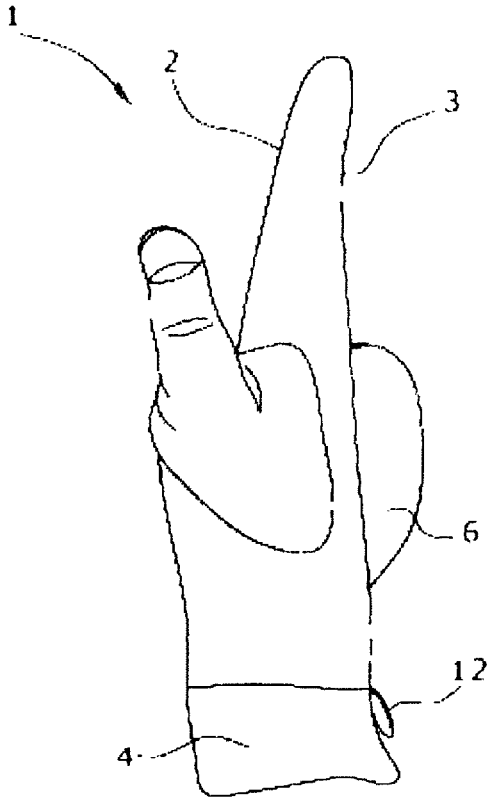

FIG. 3 shows an embodiment in which a pocket (6) is positioned on the dorsal side (3) of the four-fingered cosmetic glove (1). The bag (7) is within the pocket (6). As shown in FIG. 4, it is attached through a fastener (13) to the pocket (6) or to the dorsal side (3) of the glove. If the bag (7) is pulled over the fingers, the four-fingered cosmetic glove (1) according to the invention now adopts the shape of a mitten in which the thumb has been left away, as shown in FIG. 5. This enables the homogeneous application of powdery make-up products, also to large areas.

In order that the bag (7) can be pulled over the fingers, it has a semicircular, semi-oval or ergonomic design. "Ergonomic" as used herein means that the bag (7) does not have a symmetric design, but its contour orients itself by the lengths of fingers D II to D V. Usually, D III is the longest finger of a hand. The neighboring fingers D II and D IV are mostly shorter than D III, but are similar in length. D V is mostly substantially shorter than the neighboring D IV. In an ergonomic design, this is taken into account for the contour of bag (7).

Preferably, the bottom side (8) of bag (7) includes the same material as the palmar side (2) of the glove. The use of an elastic material also enables the bag (7) to be more easily slipped over the fingers. The fiber pile fabric enables a powdery make-up product to be uniformly applied.

If the bag (7) is positioned in the pocket (6) on the dorsal side (3) of the glove, it can simultaneously serve as a cushion. Further cushioning of the pocket (6) is not necessary then.

In a further embodiment, the four-fingered cosmetic glove (1) according to the invention further includes at least one slot (10) in at least one of fingers D II to D V in the zone of the respective proximal interphalangeal joint. When working with fatty make-up products, it may be necessary that one or more fingers, preferably D II, are not covered by the glove. Because of the slot (10), it is possible for the corresponding finger or fingers to slip out of the four-fingered cosmetic glove (1) without having to remove the whole glove. The stripped off fingertip of the cosmetic glove (1) remains firmly attached to the rest of the glove (1). It cannot fall to the ground and get dirty. The slot (10) can be provided to any or several fingers of the four-fingered cosmetic glove (1), D II being preferred.

With this finger, which is free then, it is easier to grip individual objects. During the applying of make-up, the hair is often kept out of the face with clips. Such hair clips are also employed for fixing a hairstyle. Such clips are so delicate that they can be gripped and used exclusively with uncovered fingers. Normally, a glove must be removed completely for this and subsequently put on again. This takes time. Further, the glove may become dirty. Now, one or more fingers can slip out of the glove quickly through the slot (10). The above mentioned disadvantages are avoided.

The zone (11) of the slot (10) preferably includes an elastic, especially bi-elastic, material. The four-fingered cosmetic glove (1) according to the invention may include a different material in the zone (11) of the slot (10) than that used on the palmar side (2) and/or dorsal side (3).

In addition to make-up, make-up artists are often also responsible for the hairstyle of the person in question. Auxiliaries, such as hair clips, are used for fixing hair sections or pinning up hair. These are often kept in a small box. They must then be laboriously removed therefrom separately. In another embodiment, the four-fingered cosmetic glove (1) according to the invention includes a loop (12) at the transition between the dorsal side (3) and the wrist zone (4). Hair clips, hair slides or other tools can be attached to this loop (12).

The wrist zone (4) is designed to loosely embrace the wrist. Preferably, it comprises an elastic, especially bi-elastic, material. Hair clips, hair slides or other tools may also be attached to the wrist zone (4).

In another embodiment, the object of the present invention is achieved by the four-fingered cosmetic glove (1) according to the invention having different sizes. A fitting glove can be chosen depending on the size of the hand.

The invention claimed is:

1. A four-fingered cosmetic glove (1) comprising a palmar side (2) including the palm and lower sides of the fingers, a dorsal side (3) including the back of the hand and upper sides of the fingers, and a wrist zone (4), said palmar side (2) comprising a fiber pile fabric, and said glove having a reach-through opening (5) on the level of the thumb basal joint, wherein said dorsal side (3) has a reach-through opening or a pocket (6), said pocket (6) includes a fiber pile fabric, especially the same material as that of the palmar side (2) of the glove (1).

2. The cosmetic glove according to claim 1, characterized in that said fabric is elastic, especially bi-elastic.

3. The cosmetic glove according to claim 1, characterized in that said fabric is breathable.

4. The cosmetic glove according to claim 1, characterized in that said palmar side (2) comprises velvet, plush and/or velour.

5. The cosmetic glove according to claim 1, characterized in that said dorsal side (3) exhibits a fabric that is the same as or different from that of the palmar side (2).

6. The cosmetic glove according to claim 1, characterized in that said pocket (6) is positioned in the zone of the metacarpophalangeal joints of fingers D II to D V.

7. The cosmetic glove according to claim 1 characterized in that said pocket (6) is cushioned.

8. The cosmetic glove according to claim 1, characterized in that said reach-through opening or pocket (6) has a bag (7) including a top side (9) and a bottom side (8), which can have a semicircular, semi-oval or ergonomic design.

9. The cosmetic glove according to claim 8, characterized in that said bottom side (8) of bag (7) includes the same material as the palmar side (2) of the glove (1).

10. The cosmetic glove according to claim 1, characterized by further including at least one slot (10) in at least one of the fingers in the zone of the respective proximal interphalangeal joint.

11. The cosmetic glove according to claim 10, characterized by including a different material in the zone (11) of the slot (10) than that used on the palmar side (2) and/or dorsal side.

12. The cosmetic glove according to claim 1, characterized by further including a loop (12) at the transition between the dorsal side (3) and the wrist zone (4).

* * * * *